United States Patent [19]

Bailey

[11] 4,003,520

[45] Jan. 18, 1977

[54] LAWN SPRINKLER WITH REPLACEABLE SPRINKLER ASSEMBLY

[75] Inventor: Gordon Keith Bailey, Pompano Beach, Fla.

[73] Assignee: Plastic Industries, Inc., Pompano Beach, Fla.

[22] Filed: June 18, 1975

[21] Appl. No.: 587,959

[52] U.S. Cl. ..... 239/205; 239/600

[51] Int. Cl.[2] ..... B05B 15/10; B05B 1/00

[58] Field of Search ..... 239/203–206, 239/600

[56] References Cited

UNITED STATES PATENTS

| | | | |
|---|---|---|---|
| 1,790,358 | 1/1931 | Tyrrell | 239/204 |
| 1,865,906 | 7/1932 | Harford | 239/205 |
| 1,906,621 | 5/1933 | Knuth | 239/204 |
| 2,269,919 | 1/1942 | Scherrer | 239/204 |
| 2,315,911 | 4/1943 | Truedson | 239/205 |
| 2,513,047 | 6/1950 | Pfeiffer | 239/204 |
| 2,689,001 | 9/1954 | Leysen | 239/205 X |
| 3,002,696 | 10/1961 | Jenkins | 239/205 |
| 3,335,959 | 8/1967 | Lockwood | 239/204 |
| 3,716,192 | 2/1973 | Hunter | 239/205 |

*Primary Examiner*—Robert S. Ward, Jr.
*Attorney, Agent, or Firm*—Lerner, David, Littenberg & Samuel

[57] ABSTRACT

A lawn sprinkler which may be easily disassembled for replacement of the sprinkler assembly or parts thereof to accommodate changes in surrounding soil or grass level. The lawn sprinkler includes a sprinkler body having its upper end opened and an inlet at its bottom end for receiving water into the sprinkler body from an underground supply of water under pressure. A suitable closure member is removably connected to the upper end of the sprinkler body and includes a central passageway. A sprinkler assembly is mounted for movement relative to the sprinkler body between a retracted position and an extended position and includes a longitudinally extending pipe for the passage of water under pressure therethrough. The sprinkler assembly may be easily removed from the sprinkler body for replacement of parts by simply removing the closure member from the upper end of the sprinkler body.

4 Claims, 4 Drawing Figures

LAWN SPRINKLER WITH REPLACEABLE SPRINKLER ASSEMBLY

FIELD OF THE INVENTION

The present invention relates to a lawn sprinkler and particularly relates to such a sprinkler which may be easily disassembled for replacement of parts thereof to accommodate changes in surrounding soil or grass level, or to perform normal maintenance and cleaning of the lawn sprinkler in a quick and easy manner without the need for any tools.

BACKGROUND OF THE INVENTION

It is well known in the lawn sprinkler art to provide apparatus for adjusting the height of a sprinkler head relative to the surrounding ground level. For example, U.S. Pat. No. 3,084,869 to Hutty et al discloses an adjustable sprinkler in which height adjustment is accomplished by rotating an inner pipe section to permit axial adjustment thereof relative to an outer pipe section. Another patent which employs an adjustable extension for sprinkler systems in U.S. Pat. No. 1,833,040 to Rader. In this patent, rotation of an inner pipe member will raise the inner member relative to an outer pipe member to adjust the height thereof. A different type of adjustable arrangement is disclosed in U.S. Pat. No. 3,684,179 to Fischer et al. In this patent, a pin is mounted on an inner tube member, and the height to which the sprinkler head is extended may be adjusted by rotating the inner tube member and pin relative to a coil spring which vertically displaces the inner tube relative to an outer tube.

Accordingly, although the prior art discloses a number of ways for adjusting the height of a lawn sprinkler, it does not appear that the prior art discloses the concept of a replaceable sprinkler assembly in which the sprinkler assembly or parts thereof may be replaced to accommodate changes in surrounding soil or grass level, and to allow for easy maintenance of the lawn sprinkler. In addition, conventional lawn sprinklers do not appear to be constructed and arranged to receive therein sprinkler assemblies of different heights in accordance with the surrounding ground level; in contrast, conventional lawn sprinklers primarily appear to be adjustable by varying the relative position of two telescopically arranged inner and outer pipes. Therefore, the longitudinal dimension of the outer pipe places an upper limit on the longitudinal dimension of the inner pipe, which is housed or completely received within the outer pipe. Accordingly, the extent to which conventional lawn sprinklers may be adjusted is usually limited to a narrow range controlled by the dimensions of the inner and outer pipes.

Further, conventional lawn sprinklers, which are of the adjustable type, are not constructed and arranged for easy replacement of parts or for easy maintenance due to their rather complex structure. Typically, for replacement and/or maintenance purposes, the entire lawn sprinkler must be disconnected from the underground water supply system so that the lawn sprinkler may be serviced.

In view of the foregoing, present lawn sprinklers, although adjustable, have serious drawbacks with respect to their limits of adjustability to accommodate surrounding ground levels as they change, and with respect to the replacement of parts and normal maintenance.

Therefore, it is an object of the present invention to provide an improved lawn sprinkler, which is easily adjustable over a wide range and which is easy and inexpensive to maintain, as it may be quickly disassembled for replacement of the sprinkler assembly or parts thereof to accommodate changes in surrounding ground level, or to perform normal maintenance operations.

SUMMARY OF THE INVENTION

In accordance with the principles of the present invention, there is provided a lawn sprinkler which includes a sprinkler body having its upper end opened to receive a closure member and an inlet at its bottom end for receiving water into the sprinkler body from an underground supply of water under pressure. A suitable closure member is removably connected to the upper end of the sprinkler body and includes a central passageway. A sprinkler assembly is mounted for movement relative to the sprinkler body between a retracted position and an extended position and includes a longitudinally extending pipe for the passage of water under pressure therethrough. The upper end of the pipe is slidably movable through the central passageway and extends out of the sprinkler body so that the upper end of the pipe extends out of the sprinkler body a sufficient distance such that a sprinkler head may be removably connected to the upper end thereof, even with the sprinkler assembly in its retracted position. A base member is connected to the lower end of the pipe and is responsive to water under pressure received through the inlet to actuate the sprinkler assembly from its retracted position to its extended position, whereby water is forced through the pipe and is dispersed by the sprinkler head. A coil spring is mounted on the pipe and is compressed when the sprinkler assembly is actuated to its extended position and operates to urge the sprinkler assembly from the extended position to the retracted position when the water under pressure is discontinued. As will be explained in greater detail below, the sprinkler assembly may be easily removed from the sprinkler body for replacement of parts by simply removing the closure member from the upper end of the sprinkler body.

Accordingly, it will be clear that the structure of the present invention provides a number of advantages. Most importantly, the lawn sprinkler may be easily disassembled for replacement of parts and/or for normal maintenance. Such replacement of parts includes changing the sprinkler assembly pipe for a longer one in order to accommodate changes in surrounding soil or grass level. In addition, the structure of the lawn sprinkler of the present invention is such that it can accommodate sprinkler assembly pipes of any desired length and the sprinkler body does not limit the length of the sprinkler assembly pipes which may be employed. Finally, it is also an important feature of the present invention that the lawn sprinkler may be easily and quickly disassembled for replacement and maintenance purposes without the need for any tools or special implements. The lawn sprinkler of the present invention may be serviced completely manually, as all parts may be assembled and disassembled by simple threading operations.

The above description, as well as further objects, features, and advantages of the present invention will be more fully understood by reference to the following detailed description of the presently preferred, but nonetheless, illustrative, embodiment in accordance with the present invention, when taken in conjunction with the accompanying drawings, wherein.

Figure 3:
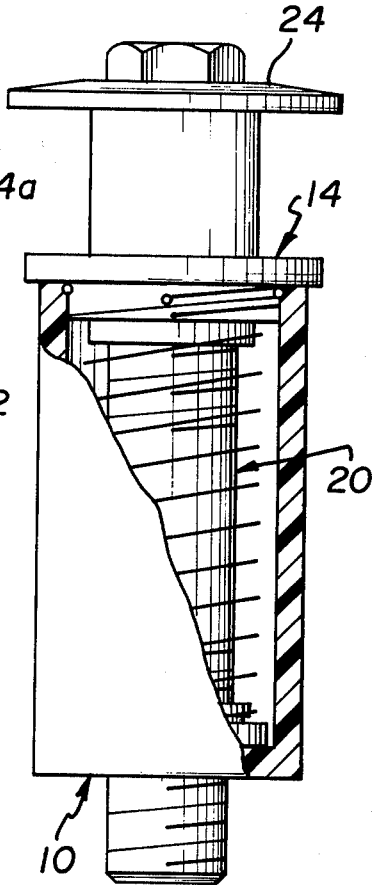
Figure 4:
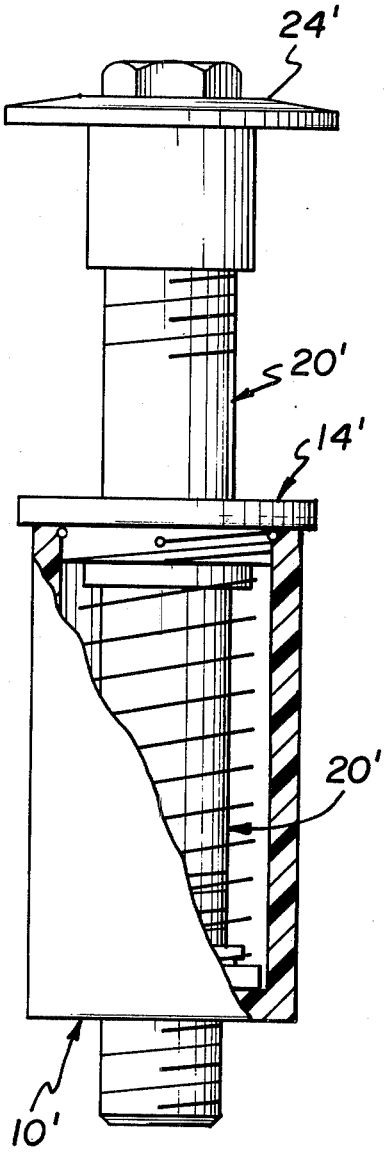

FIG. 3 is a front elevational view, with parts broken away and in section for purposes of clarity, illustrating the sprinkler assembly of the present invention in its fully retracted position; and FIG. 4 is a front elevational view, with parts broken away and in section for purposes of clarity, with the sprinkler assembly including a modified or extended pipe, with the sprinkler assembly being in its fully retracted position.

DETAILED DESCRIPTION OF THE INVENTION

Figure 1:
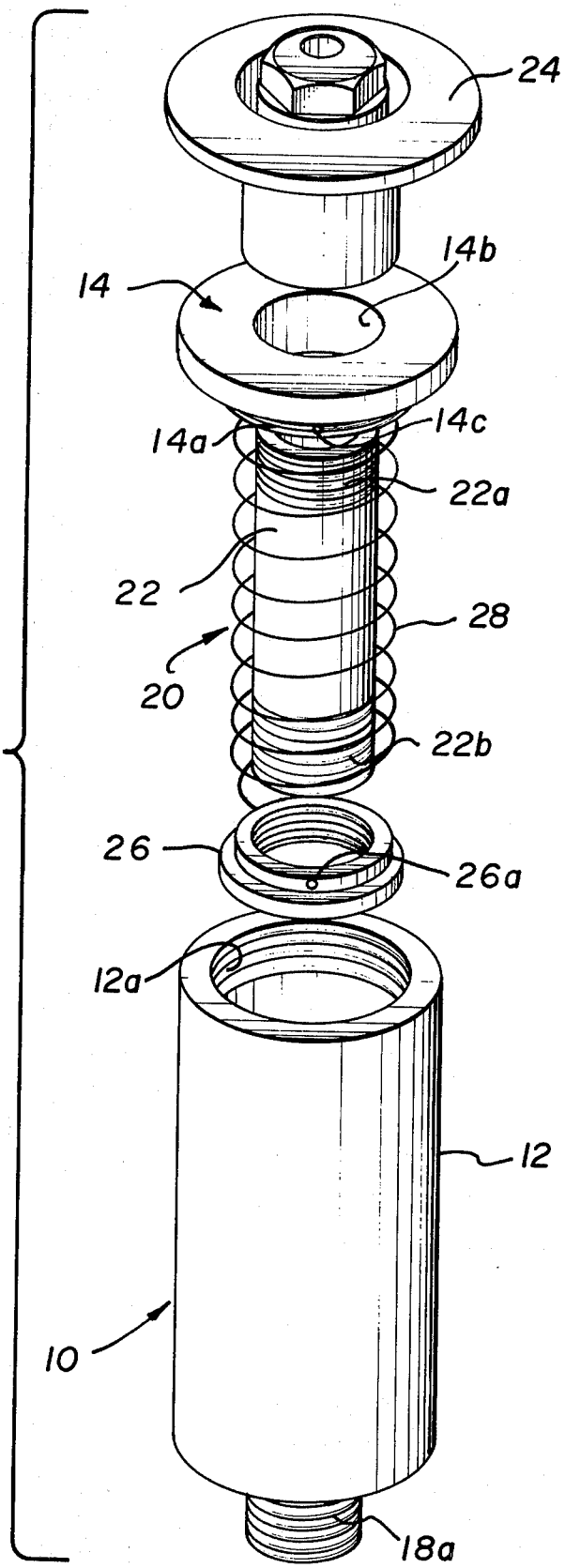
FIG. 1 is an exploded perspective view of a lawn sprinkler embodying the features of the present invention.

Referring now specifically to the drawings and in particular to FIG. 1, there is shown an illustrative lawn sprinkler embodying features of the present invention, generally designated by the reference numeral 10, which includes a sprinkler body 12 having a substantially cylindrical shape and which may be constructed from any suitable material, such as metal or plastic. In the preferred embodiment, the lawn sprinkler may be molded from a suitable plastic material. The upper end of sprinkler body 12 is opened and is provided with internal threads 12a and is adapted to receive a closure member 14. The sprinkler body 12 also includes a bottom wall 16 having an inlet 18 at the bottom end thereof for receiving water under pressure into sprinkler body 12 from an underground supply of water (not shown). Inlet 18 is provided with any suitable means, such as external threads **18*a* for connecting sprinkler body 12** to the underground water supply.

Closure member 14 is provided with external threads **14*a*, which are adapted to matingly engage internal threads 12*a* formed on sprinkler body 12 so that closure member 14 may be removably connected to the upper end of sprinkler body 12. Closure member 14 is also provided with a central passageway or an opening 14*b* through which a sprinkler assembly 20 is adapted to slide between its retracted and extended positions. Closure member 14 is also provided with suitable means for connecting the upper end of coil spring 28 of sprinkler assembly 20 to closure member 14, which may take the form of suitable hole 14*c***.

Figure 2:
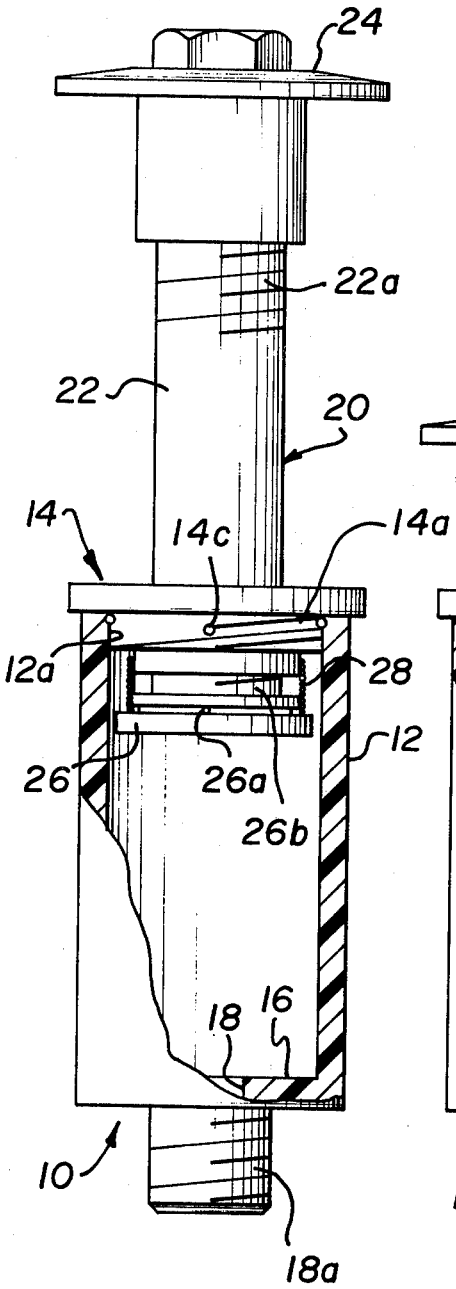
FIG. 2 is a front elevational view, with parts broken away and in section for purposes of clarity, illustrating the sprinkler assembly of the present invention in its extended position.

A sprinkler assembly 20 is mounted for movement relative to sprinkler body 12 between the retracted position shown in FIG. 3 and the extended position shown in FIG. 2. The sprinkler assembly 20 includes a longitudinally extending pipe 22 for the passage of water therethrough received through inlet 18. Pipe 22 may be formed from any suitable material and is preferably molded from a suitable plastic material. Pipe 22 is mounted in sprinkler body 12 so that its upper end 22a extends through central passageway **14*b* and out of sprinkler body 12. In this manner, when sprinkler assembly 22 is in its retracted position, the upper end 22*a* of pipe 22 extends above closure member 14 a suitable distance to receive a sprinkler head 24. Sprinkler head 24 is internally threaded and may be removably connected to the upper end 22*a* of pipe 22, which is externally threaded. Accordingly, the lawn sprinkler of the present invention has as a feature thereof that different types of sprinkler heads may be connected to pipe 22 depending on the type of spray desired. As sprinkler head 24 is removably connected to pipe 22, it is easy to install or replace sprinkler head 24**.

A base member 26 is also removably connected to the lower end **22*b* of pipe 22. Base member 26 may be connected to pipe 22 in any suitable manner, such as by base member 26 being provided with internal threads and pipe 22 being provided with external threads so that base member 26 may be easily connected or disconnected to pipe 22. Base member 26 is adapted to have applied thereto the water received under pressure through inlet 18 and is responsive to the water pressure to actuate sprinkler assembly 20 from the retracted position shown in FIG. 3 to the extended position shown in FIG. 2. In the extended position, the water under pressure which enters through inlet 18 into sprinkler body 12 is forced through pipe 22 and is dispersed by sprinkler head 24 to the surrounding area or lawn. In actual operation, only approximately 6 pounds per square inch of water pressure is neceassary to actuate sprinkler assembly 20** to its extended position.

A coil spring 28 is provided to surround pipe 22 and is connected at its upper end to hole 14c formed in closure member 14 and is connected at its bottom end to a hole **26*a* formed in base member 26. Coil spring 28 operates to be compressed when sprinkler assembly 20 is actuated to its extended position with the coil spring 28 being compressed between the inner wall of closure member 14 and the upper wall of base member 26. In addition, coil spring 28 also operates to bias or urge sprinkler assembly 20 from the extended position shown in FIG. 2 to the retracted position shown in FIG. 3 when the water pressure is discontinued. As a result, coil spring 28 operates to force base member 26 downwardly within sprinkler body 12 to its lowest position so that base member 26 engages the bottom wall 16 of sprinkler body 12 and thereby limits the movement of sprinkler assembly 20 to its retracted position. Further, as base member 26 is urged downwardly within sprinkler body 12 by coil spring 28, it forces the water contained within sprinkler body 12 out through inlet 18. Accordingly, it should be clear that the engagement of bottom wall 16 by base member 26 limits the downward movement of sprinkler assembly 20; it is not limited by sprinkler head 24 engaging closure member 14. In this manner, pipe 22 may be of any length beyond that shown in FIGS. 2 and 3, such as that shown in FIG. 4, and the sprinkler body 12 of the present invention will accommodate the longer pipe 22′ and still be operative. This is because the lawn sprinkler of the present invention is constructed and arranged so that the sprinkler head 24 is outside of the sprinkler body 12 and thereby places no limitation on the length of pipe 22. In addition, as sprinkler head 24 has no affect on limiting the movement of sprinkler assembly 20 to its retracted position, this also allows pipe 22 to be of any length. Accordingly, the present invention is constructed and arranged so that pipe 22 may be of any desired length and extend any distance above the height of sprinkler body 12** to accommodate any changes in the surrounding soil or grass level.

As shown in FIG. 4, the longer pipe 22′ operates in the same manner as described with respect to pipe 22 and includes a base member 26′ at the bottom end thereof to limit the movement of the sprinkler assembly 20' to its retracted position. In this manner, when sprinkler assembly 20' is actuated to its extended position, it will compress coil spring 28' in the same manner as coil spring 28, the only difference being that pipe 22' and sprinkler head 24' will be extended to a greater extent than pipe 22 and sprinkler head 24.

Sprinkler assembly 20 is adapted to be removable from sprinkler body 12 for replacement thereof or for replacing pipe 22 with a longer pipe 22', as shown in FIG. 4. To perform the replacement, it is only necessary to perform a simple disassembly operation. More particularly, sprinkler head 24 is removed from the upper end 22a of pipe 22. Then, closure member 14 is unscrewed from the upper end of sprinkler body 12 and is removed from the interior of sprinkler body 12 along with the remainder of sprinkler assembly 20. Accordingly, it should be clear that it is not necessary to disconnect sprinkler body 12 from the underground water supply and it remains in position while sprinkler assembly 20 is removed. To disassemble the sprinkler assembly 20, it is only necessary to disconnect coil spring 28 from hole **14*c* in closure member 14 and hole 26a in base member 26. Then, closure member 14 is free to be slid off of pipe 22, and base member 26 may be then unscrewed from the lower end of pipe 22. Of course, any suitable seals or gaskets are also removed. Then, pipe 22 is interchanged with a longer pipe 22' , as shown, for example, in FIG. 4, and the new sprinkler assembly 20' is then reassembled by simply screwing the base member 26 onto the lower end of new pipe 22'. Then, coil spring 28 and closure member 14 are slid onto new pipe 22' with the ends of the coil spring 28 connected to base member 26 at 26*a* and closure member 14 at 14*c*. Then, the same or a different sprinkler head 24 is threaded onto the upper end 22*a* of pipe 22'. The hole assembly is then ready to be inserted within sprinkler body 12 and to make this final connection, it is only necessary for closure member 14 to be threaded to the upper end 12*a* of sprinkler body 12**.

As a result, the present invention is constructed and arranged so that it is simple to disassemble and to replace the entire sprinkler assembly 20 quickly and easily or to change one size pipe 22 for another size pipe 22'. In this manner, the same lawn sprinkler may be employed on a lawn permanently, as it is only necessary to change pipe 22 when the surrounding soil or grass level changes. Moreover, this simple disassembly operation allows normal maintenance and cleaning of the lawn sprinkler to be done in a quick and easy manner without the need for any tools.

A latitude of modification, change and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A lawn sprinkler which may be disassembled for replacement of the sprinkler assembly to accommodate changes in surrounding soil or grass level, comprising:

a sprinkler body having a substantially cylindrical shape, the upper end thereof being opened, an inlet at the bottom end thereof for receiving water into said sprinkler body from an underground supply of water under pressure, and a closure member removably connected to the upper end of said sprinkler body and including a central passageway, a sprinkler assembly mounted for movement relative to said sprinkler body between a retracted position and an extended position including a longitudinally extending pipe for the passage of water therethrough, said pipe being arranged to slidably extend through said central passageway so that the upper end is outside of said sprinkler body, a sprinkler head removably connected to the upper end of said pipe, a base member connected to the lower end of said pipe and responsive to water received under pressure through said inlet to actuate said sprinkler assembly from said retracted position to said extended position, whereby water is forced through said pipe and is dispersed by said sprinkler head, a coil spring mounted on said pipe and operatively connected thereto to be compressed when said sprinkler assembly is actuated to said extended position, and to be expanded for urging said sprinkler assembly from said extended position to said retracted position upon the discontinuation of water pressure, and said sprinkler assembly and coil spring being so constructed that they are slidably removable as a unit and in a single operation from the upper end of said sprinkler body for replacement thereof with different length pipes to accommodate changes in surrounding soil or grass level requiring only the removal of said closure member from the upper end of said sprinkler body which is accomplished manually and without any tools while said sprinkler body remains connected to said underground water supply.

2. A sprinkler in accordance with claim 1 wherein said closure member and said base member each include means for connecting said coil spring thereto.

3. A sprinkler in accordance with claim 2 wherein said sprinkler body includes means at the bottom end thereof for connecting said sprinkler body to a source of water under pressure.

4. A sprinkler in accordance with claim 1 wherein said base member is constructed to engage the bottom wall of said sprinkler body to limit the movement of said sprinkler assembly to said retracted position.

* * * * *